United States Patent [19]

Izumi

[11] 4,107,900

[45] Aug. 22, 1978

[54] FORMING AND FILLING BAGS OF SYNTHETIC PLASTICS MATERIALS

[76] Inventor: Shinjiro Izumi, 1-17-5 Ryoke, Urawa-shi, Japan

[21] Appl. No.: 803,318

[22] Filed: Jun. 3, 1977

[51] Int. Cl.[2] ..... B65B 9/12

[52] U.S. Cl. ..... 53/180 R; 53/182 R; 53/183; 53/202

[58] Field of Search ..... 53/180 R, 182 R, 183, 53/202, 178

[56] References Cited

U.S. PATENT DOCUMENTS

| | | | |
|---|---|---|---|
| 2,162,230 | 6/1939 | Salfisberg | 53/51 X |
| 2,616,232 | 11/1952 | Meyer | 53/182 R X |

*Primary Examiner*—Travis S. McGehee

*Attorney, Agent, or Firm*—Armstrong, Nikaido, Marmelstein & Kubovcik

[57] ABSTRACT

Apparatus for forming and filling bags of synthetic plastics material comprising feed means for feeding a flattened tube of synthetic plastics material through the apparatus; a cutting device for cutting the tube substantially along the mid-line thereof to produce two strips of material, each of which strips is open along one edge; a tube for filling the bags, which tube is constructed to pass between the edges of each strip of material and to open into the interior of each strip; sealing means for sealing together the open edges of each strip of material to form two further tubes; and cutting and sealing means for sealing simultaneously the top and bottom of adjoining bags and for separating the bags from one another.

7 Claims, 6 Drawing Figures

FORMING AND FILLING BAGS OF SYNTHETIC PLASTICS MATERIALS

FIELD OF THE INVENTION

This invention relates to an apparatus for forming and for filling bags of a synthetic plastics material.

DESCRIPTION OF THE PRIOR ART

Previously, bags of synthetic plastics material have been made from a single flat sheet of synthetic plastics material. This means that one side of the sheet which is to constitute the inside of the bags is in contact with that side of an adjacent layer which is to form the outside of the bags. Thus, for example, if there is any printing on that surface of the sheet which is to form the outside of the bags, this printing is in contact with a surface which is to form an inside surface of the bags. This results in the possibility that the inside of the bags may not be totally hygenic.

OBJECT OF THE INVENTION

It is an object of the present invention to ensure that the bags are made and filled under hygenic conditions.

It is a further object of the present invention to provide a means by which the bags can be made more efficiently and at a lower cost.

SUMMARY OF THE INVENTION

According to one aspect of the present invention, there is provided an apparatus for forming and for filling bags of a synthetic plastics material, which apparatus comprises:

feed means for feeding a flattened tube of synthetic plastics material through the apparatus;

a cutting device for cutting the tube substantially along the mid-line thereof to produce two strips of material, each of which strips is open along one edge;

a tube for filling the bags, which tube is constructed to pass between the edges of each strip of material and to open into the interior of each strip;

sealing means for sealing together the open edges of each strip of material to form two further tubes; and cutting and sealing means for sealing simultaneously the top and bottom of adjoining bags and for separating the bags from one another.

According to a second aspect of the present invention, there is provided a method of forming and of filling bags of a synthetic plastics material, which method comprises the steps of:

feeding a flattened tube of synthetic plastics material to a cutting device;

cutting the tube substantially along the mid-line thereof to produce two strips of material, each of which strips of material is open along one edge;

passing each strip of material over a tube for filling the bags so that the tube passes between the edges of the strip and opens into the interior of the strip;

sealing together the open edges of each strip of material to form two further tubes; and sealing simultaneously the top and bottom of adjoining bags and separating the bags from one another.

Preferably, the cutting device comprises a knife mounted on a centering device, the centering device including two arms for engaging with the inside of the edges of the flattened tube.

One of the arms may be resilient to accommodate variations in the width of the flattened tube.

The apparatus preferably includes a pair of angled guide rollers for aligning each strip as it passes to the sealing means.

Preferably, the sealing means comprises a pair of endless belts for receiving the cut edges of one of the strips therebetween, and a heater for heating the belts so as to seal the edges of the strip. The apparatus may also include a cooler for cooling the sealed edges of the strip.

The apparatus preferably includes a device for supplying hot air to the gap between the cut edges of each strip, which gap is formed as the strip passes over the tube.

For a better understanding of the present invention, and to show more clearly how the same may be carried into effect, reference will now be made, by way of example, to the accompanying drawings, in which:

DESCRIPTION OF PREFERRED EMBODIMENTS

The Figures show an apparatus for forming a bag from a tube made of a synthetic plastics material and for filling the bag. The apparatus comprises a roller 12 onto which there is wound a flattened tube 11 of a plastics material. The tube passes over a first roller 13 and over a second roller 13 and then passes between two rollers 15 which feed the tube through the apparatus.

Figure 2:
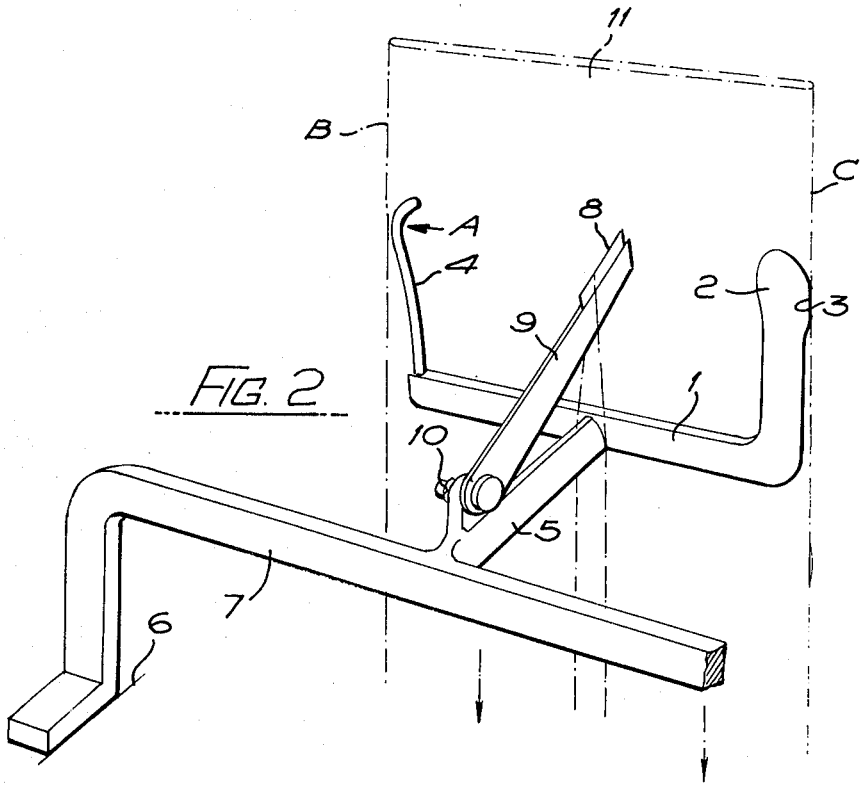
FIG. 2 is a perspective view, to a larger scale, of a tube slitting device shown in FIG. 1.
Figure 4:
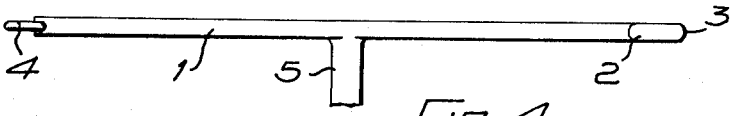
FIG. 4 is a plan view of the tube slitting device shown in FIG. 2.
Figure 3:
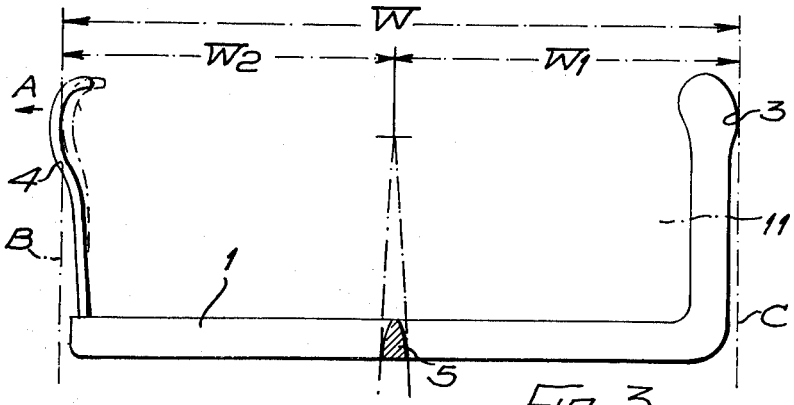
FIG. 3 is an elevational view of the tube slitting device shown in FIG. 2.

Upstream of the rollers 15 there is provided a tube cutting device 1 for slitting the tube substantially along its mid-line. The slitting device 1 is shown most clearly in FIGS. 2, 3 and 4 and comprises an arm 2 which is positioned within the tube 11 and which is urged against one edge C of the tube by means of a further arm 4 which engages with the opposite edge B of the tube. Arm 4 is resilient and serves to maintain the edge C of the tube against an edge 3 of the arm 2. As the tube 11 passes over the slitting device, it is cut substantially at its mid-point by means of a knife 8 which is mounted on a member 5, which member 5 also supports the arms 2 and 4.

The distance between the knife 8 and the arm 2 is always constant. Thus the width W1 (FIG. 3) of one part of the cut tube is also constant. However, the width W of the tube is not always constant. It may vary, for example, by up to 3 mm. Thus, as the width of the bag varies, the arm 4 moves towards or away from the arm 2 and maintains the edges of the tube against the edge 3 of the arm 2 and against a portion A of the arm 4. It will be appreciated, therefore, that the width W2 of the other part of the cut tube will also vary slightly.

The knife 8, which is mounted on an arm 9, should cut the tube at the same height as the tube contacts the arms 2 and 4. For this purpose, the arm 9 is mounted on member 5 by means of a pivotable mounting 10 so that the elevation of the knife 8 can be varied.

The member 5 is mounted on a bar 7, which bar is secured to the remainder of the apparatus at 6.

As the knife 8 slits the tube 11, it divides the tube into two strips 11*a* and 11*b*. In order to simplify this description, the operations on strip 11*a* only will be described in detail. However, it will be understood that the operations on strip 11*b* are substantially the same as those on strip 11*a*.

Figure 1:
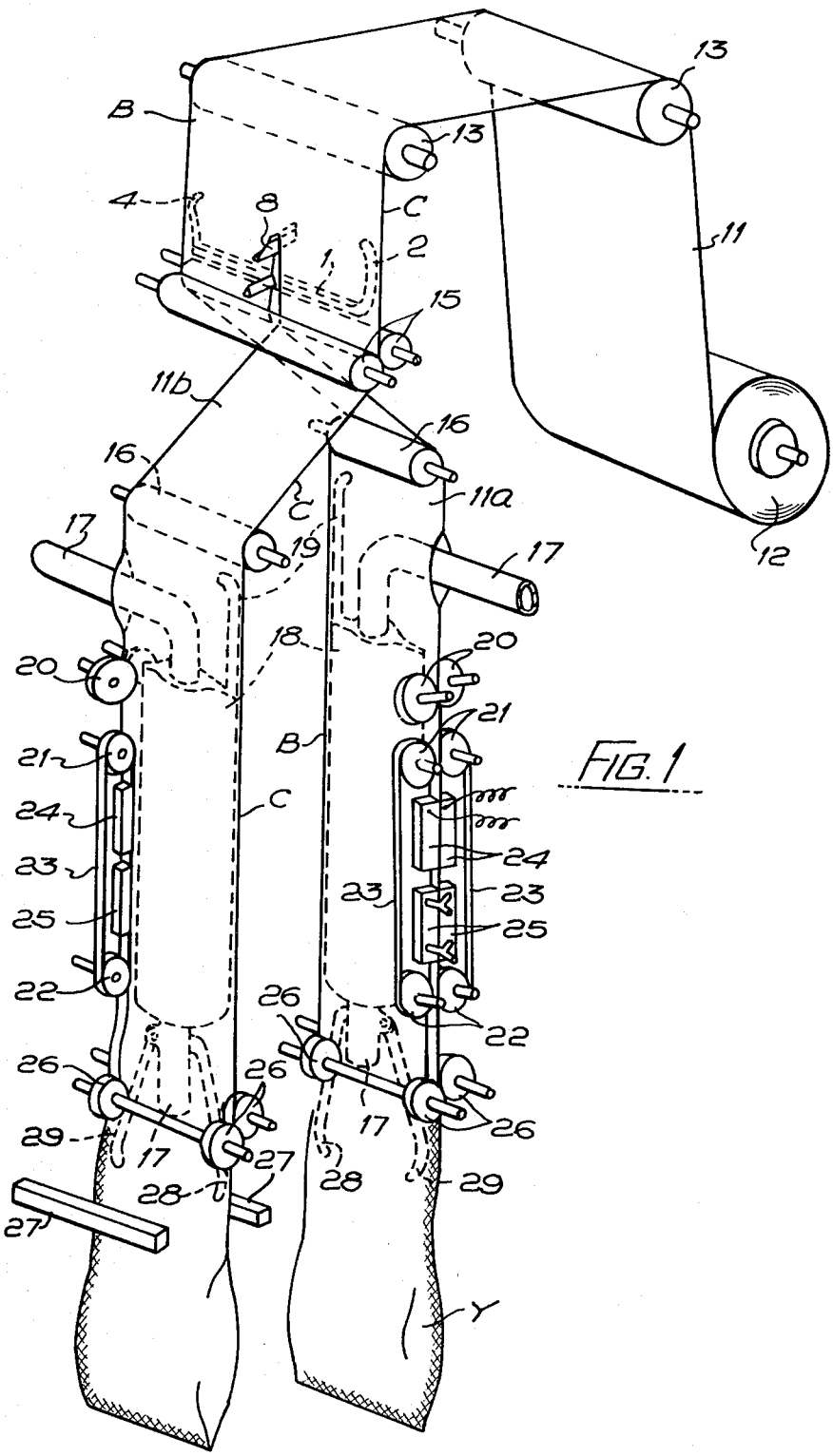
FIG. 1 is a perspective view of the general arrangement of a bag forming and filling apparatus in accordance with the present invention.

After the tube has been slit, strip 11*a* passes over a guide roller 16 and is fed over a pipe 17, which pipe is provided with guides 18 and 19. Guide 19 should preferably be spaced a short distance below the roller 16. It will be noted that FIG. 1 shows that the distance between the rollers 15 and the roller 16 for strip 11*a* is different from the distance between rollers 15 and the roller 16 for strip 11*b*. This arrangement is advantageous in some embodiments when it is desired to position cutting and fusing bars 27 (described hereinafter) for one strip at a different level to cutting and fusing bars for the other strip.

After passing over guide roller 16, the cut edges of the strip 11*a* pass between two rollers 20. The two rollers 20 are angled with respect to one another and pull on the cut edges of the strip in the widthwise direction of the strip to align the same over the guide 18. The aligned strip then passes between two endless belts 23, which belts are guided over two pairs of rollers 21 and 22. Rollers 21 rotate freely, but rollers 22 are driven by a drive means (not shown). The driven roller 22 drives the other roller 22 by means of a gear wheel (not shown).

The belts 23 carry the cut edges of the strip through a pair of heat sealing devices 24 and thereafter through a pair of water-cooled devices 25. The cut edges are sealed due to the fact that the belts are heated by the heat sealing devices 24. In order to prevent the strip adhering to the belts, the belts may be coated, for example with TEFLON (Registered Trade Mark).

The edges of the 11*a* then pass through a pair of rollers 26 which are also driven by the drive means (not shown). To assist in maintaining rollers 22 and 26 in synchronism, the drive (not shown) to one of the rollers 22 is fitted with a ratchet device to enable the roller to rotate freely if necessary. The strip 11*a* is fed by the rollers 26 in a continuous manner, but the heat sealing devices 24 are operated intermittently i.e. a portion of the cut edges is first heat sealed, then the sealing devices 24 are moved apart and the sealed portion passes to the cooling devices 25, thereafter the sealing devices 24 are moved together again and a further portion of the cut edges is heat sealed to form a continuous sealed edge. Since the strip is fed continuously by the rollers 26, the tube accumulates temporarily, for example below the rollers 26.

After it passes between the rollers 26, the strip 11*a* is aligned by means of guide arms 28 and 29. The guide arms are mounted on the lower end of pipe 17 and guide arm 29 is mounted in a resilient manner. The strip 11*a* is filled with material through pipe 17 and, after a predetermined amount of material has been charged to the strip, the strip is sealed to form a filled sachet Y, and simultaneously separated from the bottom of the strip (which is also sealed) by means of cutting and fusing bars 27. The next portion of the strip may then be filled to form another sachet, and so on. As each sachet Y is separated from the strip 11*a*, the sachet falls under its own weight onto a belt (not shown) located below the strip.

By making the sachets from a tube rather than from a strip of flat plastics sheet, it is possible to make the sachets under very hygenic conditions. For example, the outside of the tube may have printing applied to it without in any way contaminating the internal surfaces of the tube. If printing were to be applied to a sheet, as the sheet is rolled up the printing on one layer would contaminate the unprinted side of the adjacent layer. This is particularly important when the sachets are to be filled with foodstuffs. Moreover, it is possible to seal the ends of the tube 11 in order to prevent bacteria, for example, from entering the tube.

Figure 5:
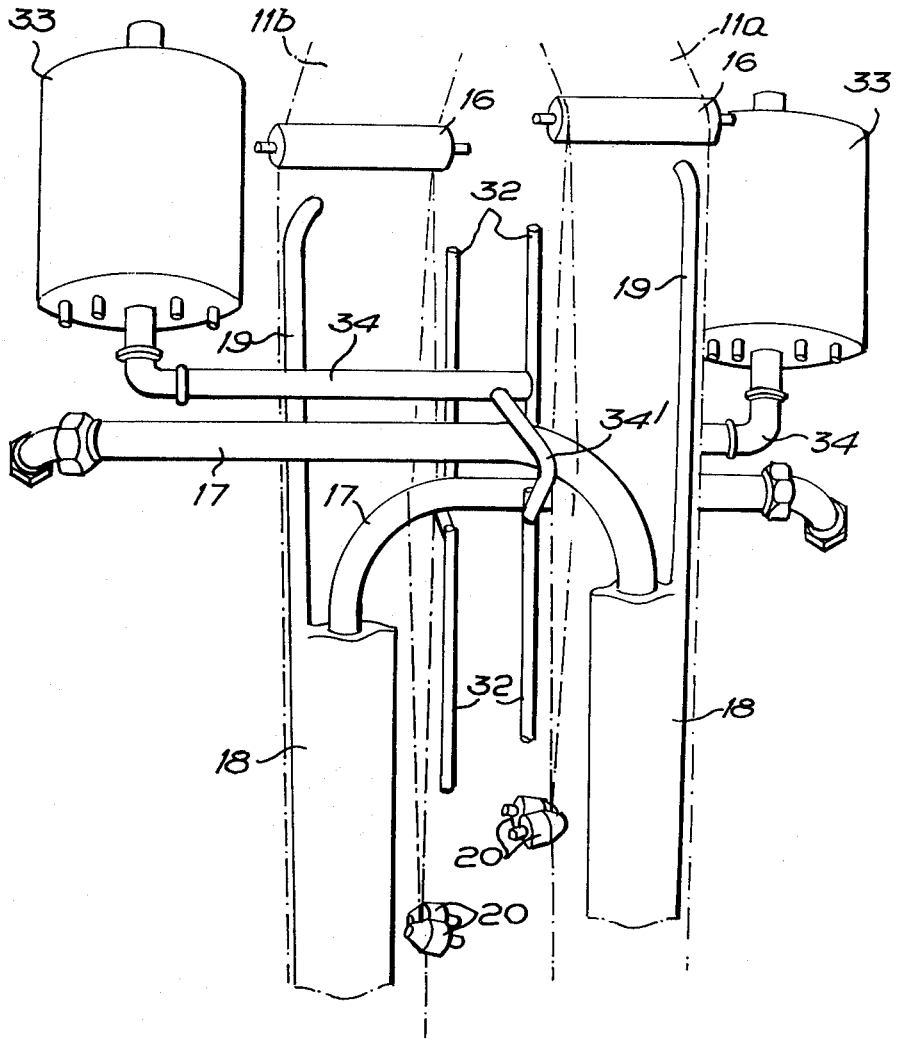
FIG. 5 is a perspective view of a device for supplying hot air to part of the apparatus.
Figure 6:
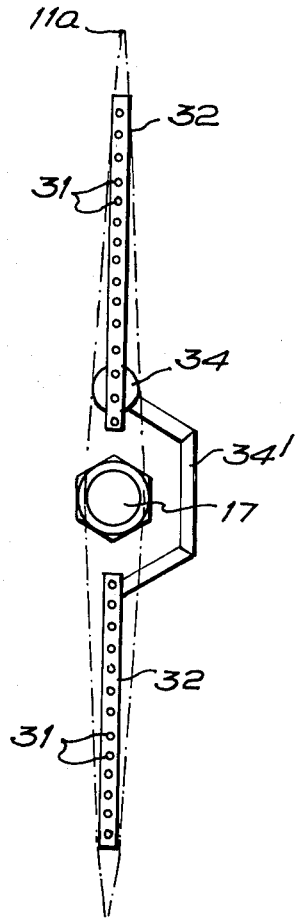
FIG. 6 is an end view of part of the device shown in FIG. 5.

Even with the use of a tube, it is still possible for bacteria to enter between the strips 11*a* and 11*b* where their cut edges are parted to allow the entry of the pipe 17. However, this may be overcome by using the device shown in FIGS. 5 and 6 of the drawings. This device supplies hot air, for example, at a temperature of 80° to 90° C, at a relatively low flow rate to the gap between the parted edges of the strips. For this purpose, the device comprises upper and lower upright arms 32. The arms are positioned outside the parted edges of the strips and are provided with openings 31 for directing hot air towards the parted edges. The hot air is fed to the arms 32 from a heater 33 via a tube 34. In FIG. 5, one of the upright arms is connected directly to the tube 34, whereas the other arm is connected to the tube 34 via an intermediate tube 34'.

The sachets may be filled, for example, with a liquid such as milk or with particulate materials such as sugar, beans or rice.

The tube used to make the sachets may be of thinner material than the sheet which has previously been used to make such sachets, thus resulting in a lower cost for each finished sachet. This is because the friction present in machines which make the sachets from a sheet-form material is greater and thus necessitates a relatively thick material to withstand the frictional forces.

In addition, since the apparatus is able simultaneously to form and to fill two bags from a single sheet of material, the apparatus is able to produce the sachets particularly efficiently.

I claim:

1. Apparatus for forming and for filling bags of a synthetic plastics material, comprising:

feed means for feeding a flattened tube of synthetic plastics material along a predetermined path through said apparatus;

cutting means for cutting said tube substantially along the mid-line thereof to produce two strips of material, each of which strips has two open edges along one side;

a tube constructed to pass between said open edges of each strip of material and to debouch into the interior of each strip;

sealing means for sealing together said open edges of each strip of material to form two further tubes; and cutting and sealing means for sealing said further tubes transversely to form simultaneously the top and bottom of adjoining bags and for separating said bags from one another.

2. Apparatus according to claim 1, wherein said cutting means comprises a knife mounted on a centering device, said centering device including two arms for engaging with the inside of the edges of said flattened tube.

3. Apparatus according to claim 2, wherein one of said arms is resilient for accommodating variations in the width of said flattened tube.

4. Apparatus according to claim 1 and including a pair of angled guide rollers for aligning each strip as it passes to said sealing means.

5. Apparatus according to claim 1, wherein said sealing means comprises a pair of endless belts for receiving therebetween said open edges of each strip, and heating means for heating said belts whereby to seal said open edges of said strip.

6. Apparatus according to claim 5 and including cooling means for cooling said sealed edges of said strip.

7. Apparatus according to claim 1 and including means for supplying hot air between said open edges of said strip as said strip passes over said tube.

* * * * *